US009027330B2

(12) United States Patent
Edholm

(10) Patent No.: US 9,027,330 B2
(45) Date of Patent: May 12, 2015

(54) EXHAUST MUFFLER COMPRISING A CATALYTIC CONVERTER

(75) Inventor: Fredrik Edholm, Jönköping (SE)

(73) Assignee: Husqvarna Aktiebolag, Huskvarna (SE)

( * ) Notice: Subject to any disclaimer, the term of this patent is extended or adjusted under 35 U.S.C. 154(b) by 287 days.

(21) Appl. No.: 12/520,499

(22) PCT Filed: Dec. 22, 2006

(86) PCT No.: PCT/SE2006/001487

§ 371 (c)(1),
(2), (4) Date: Sep. 22, 2009

(87) PCT Pub. No.: WO2008/079056

PCT Pub. Date: Jul. 3, 2008

(65) Prior Publication Data

US 2010/0011752 A1 Jan. 21, 2010

(51) Int. Cl.

| | |
|---|---|
| ***F01N 1/00*** | (2006.01) |
| ***F01N 3/10*** | (2006.01) |
| ***F01N 1/08*** | (2006.01) |
| ***F01N 13/00*** | (2010.01) |

(52) U.S. Cl.

CPC ..... *F01N 1/084* (2013.01); *F01N 1/083* (2013.01); *F01N 1/089* (2013.01); *F01N 3/10* (2013.01); *F01N 13/001* (2013.01); *F01N 13/002* (2013.01); *F01N 2230/04* (2013.01); *F01N 2590/06* (2013.01)

(58) Field of Classification Search

USPC ..... 60/299, 302, 319, 323; 181/272, 273, 181/275

See application file for complete search history.

(56) References Cited

U.S. PATENT DOCUMENTS

| | | | | |
|---|---|---|---|---|
| 4,890,690 | A * | 1/1990 | Fischer et al. | 181/240 |
| 5,521,339 | A | 5/1996 | Despain | |
| 5,732,555 | A | 3/1998 | Gracyalny et al. | |
| 5,738,184 | A | 4/1998 | Masuda et al. | |
| 5,857,327 | A * | 1/1999 | Sato et al. | 60/302 |
| 6,393,835 | B1 | 5/2002 | Stoll et al. | |
| 6,789,644 | B2 * | 9/2004 | Mukaida | 181/272 |
| 7,290,388 | B2 * | 11/2007 | Kikuchi et al. | 60/323 |

FOREIGN PATENT DOCUMENTS

EP 1600613 A1 11/2005

* cited by examiner

*Primary Examiner* — Thomas Denion
*Assistant Examiner* — Diem Tran
(74) *Attorney, Agent, or Firm* — Nelson Mullins Riley & Scarborough LLP

(57) ABSTRACT

A catalytic muffler for an internal combustion engine of a portable working tool, e.g. a chain saw or a trimmer, having a housing designed to be directly attached to an exhaust port of an engine. The housing further includes a front chamber and a rear chamber divided from each other by an intermediate baffle. The housing further having an inner housing having a first open end constituting the exhaust gas inlet located in the rear chamber. The inner housing includes a catalyst body through which essentially all exhaust gas flows when in use. A second open end of the inner housing is arranged in one of said front and rear chambers and the exhaust gas outlet of the muffler is arranged in the other chamber such that treated gas in use flows through at least one aperture in the intermediate baffle from one chamber to the other.

14 Claims, 5 Drawing Sheets

EXHAUST MUFFLER COMPRISING A CATALYTIC CONVERTER

TECHNICAL FIELD

The several embodiments disclosed herein relate to a catalytic muffler for an internal combustion engine of a portable working tool, e.g. a chain saw or a trimmer. The catalytic muffler comprises a housing designed to be directly attached to an exhaust port of an engine. The housing further comprises a front chamber and a rear chamber divided from each other by an intermediate baffle.

TECHNICAL BACKGROUND

Various exhaust gas mufflers have been known in the art. One of the issues when developing exhaust gas mufflers is to provide adequate catalytic treatment of the exhaust gas at a low gas counter pressure. A solution is disclosed in U.S. Pat. No. 6,393,835 that relates to an exhaust gas muffler on an internal combustion engine in motor chain saw. The exhaust gas muffler includes a housing that is assembled of two housing shells. The one housing shell has an exhaust gas inlet and the other housing shell has an exhaust gas outlet. An inner wall as well as a catalytic converting element is provided in the inner space of the muffler housing. The catalytic converting element is mounted between the exhaust gas inlet and the exhaust gas outlet. In order to ensure an adequate catalytic converting treatment of the exhaust gas at low gas counter pressure, it is provided to divide the entering exhaust gas flow and to conduct at least one of these component flows in contact with the catalytic converting element. The component flows are brought together and mixed with other before exiting from the muffler housing. However, not all exhaust gas is treated and the construction is relatively spacious.

In U.S. Pat. No. 5,732,555 a catalytic converter is disclosed for treating the exhaust gases of an internal combustion engine which is less expensive and easier to manufacture than other catalytic converters. This multi pass catalytic converter/muffler uses a single catalytic support bed without increasing the overall size of the catalytic converter/muffler. The outer surface area of the catalytic support bed is disposed adjacent to the outer wall of the catalytic converter housing, with only the mat in between. Secondary air may be provided upstream before the exhaust gases make their first pass through the catalytic support bed, or after the first pass but before the second pass or even after the second pass. Again, the construction is relatively large.

An invention to reduce high exhaust emission output levels is disclosed in U.S. Pat. No. 5,521,339, describing a muffler for coupling to an exhaust port of an internal combustion engine which includes a housing, a first hollow body within the housing, a catalyzer within the first hollow body, and a second hollow body within the housing. The first hollow body has an inner surface defining a first chamber and an inlet adjacent the exhaust port to admit the exhaust gas into the first chamber. The exhaust gas is exothermally treated as it flows through the catalyst in the first chamber in a direction away from the engine and passes through an outlet of the first hollow body to a second chamber. The second chamber is formed by an inner surface of the second hollow body and an outer surface of the first hollow body. The treated exhaust gas flows through the second chamber in a direction toward the engine over the outer surface of the first hollow body where a thermal reaction takes place and/or further emission reduction takes place by a catalytic coating on the outer surface of the first hollow body. The treated exhaust gas passes through an outlet of the second hollow body to a third chamber. The third chamber is formed by an outer surface of the second hollow body and an inner surface of the housing. After expanding and mixing in the third chamber, the exhaust gas is expelled from the third chamber through an outlet of the housing adjacent the engine. The volume downstream of the catalyst is however small resulting in high temperatures in the catalyst. The thermal endurance of catalysts is normally low.

EP 1 600 613 discloses a muffler for attachment to an engine that includes an inlet for receiving exhaust gases into the muffler, a catalyst assembly located within the muffler, and a fastener tube for fastening the muffler to the engine. A fastener tube cover covers the fastener tube and includes an outlet for exiting exhaust gases. The outlet includes a directional louver that directs the exiting exhaust gases. The fastener tube cover can retain a spark arrestor, which maintains maximum spark particle size in the exiting exhaust gases. One issue with this muffler is length of life for the catalyst resulting from high temperatures.

SUMMARY OF THE INVENTION

One object of the several embodiments of the present invention is to provide an improved catalytic muffler for a combustion engine to reduce some of the above-related problems.

According to several embodiments, a catalytic muffler is provided for an internal combustion engine of a portable working tool, e.g. a chain saw or a trimmer, comprises a housing designed to be directly attached to an exhaust port of an engine. The housing further comprises a front chamber and a rear chamber divided from each other by an intermediate baffle. The housing further comprises an inner housing having a first open end constituting the exhaust gas inlet located in the rear chamber. The inner housing comprises a catalyst body through which essentially all exhaust gas flows when in use, wherein the second open end of the inner housing is arranged in one of said front and rear chambers. The exhaust gas outlet of the muffler is arranged in the other chamber such that treated gas in use flows through at least one aperture in the intermediate baffle from one chamber to the other. The heat exchange in the muffler provides for a lower output temperature from the muffler. The contact with the outer wall of the housing further cools down the gas after passage through the catalyst.

Preferably, the second open end of the inner housing is arranged in the front chamber, i.e. when in use the exhaust gas that flows through the catalyst body continues into the front chamber in said housing. At least a first part of the inner surface of the front chamber constitutes a part of the outer wall of the housing and a second part is the intermediate baffle with at least one aperture. The intermediate baffle separates the front chamber from the rear chamber. The rear chamber has at least a part of its inner surface constituting a part of the outer wall of the housing. The rear chamber comprises an outlet for the treated exhaust gas and the rear chamber preferably at least partly surrounds the exhaust gas inlet such that during use there is a counterflow heat exchange between the exhaust gas in the inlet upstream of the catalyst body and the treated exhaust gas. Thus, the cooling of the gas leaving the muffler is improved In an alternative embodiment, the second open end of the inner housing is instead arranged in the rear chamber, i.e. when in use the exhaust gas that flows through the catalyst body continues into the rear chamber in said housing. According to this embodiment, the rear chamber will have the highest temperature allowing the gas to cool down on its way into the front chamber and also being further cooled before it leaves the front chamber. Thus, for the user, this embodiment provides for a muffler that has an outside surface temperature of the muffler, the larger part facing the user that is lower than in the other embodiment where the second open end of the inner housing is arranged in the front chamber.

Preferably, the at least one aperture in the intermediate baffle is located adjacent the housing of the catalytic muffler. This aperture or apertures are arranged close to the inner surface of the housing and thereby controlling the gas to flow close to the inner surface of the housing in order to maximize the convection of heat for cooling the gas, i.e. decreasing the temperature of the gas to a larger extent.

Further, the housing of catalytic muffler preferably comprises two mating parts. The inner housing preferably also comprises two mating parts. Preferably, at least one of these two parts has a recess for fitting the catalyst body. The edges of two mating parts in contact can for instance be folded to assemble the muffler and/or the inner housing, i.e. neither welding nor soldering is needed, if desired. Of course, welding and/or soldering or any other means of fixing the two mating parts to each other could be used. The recess is preferably arranged such that when assembling the inner housing, the catalyst body is just placed in the recess of one of the parts and the other part is combined with the first part to secure the position of the catalyst body. In an alternative embodiment both of the two mating parts have recesses for fixing the catalyst body in a specific position in the inner housing. This specifically applies when the cross section of the catalyst body is circular. Both of the mating parts should in this case preferably have equally sized recesses for facilitating mounting or dismounting of the catalyst body in the inner housing, i.e. to avoid having to force the catalyst body into one of the parts. Alternatively, one part could be slightly larger, i.e. carry more than half of the catalyst body, for retaining the catalyst body during assembly with a snap like fitting.

In a further embodiment the joint between the two mating parts of the inner housing is arranged such that it in use is in an essentially vertical plane perpendicular to the exhaust inlet and the first open end, thus enabling making at least one bend in said plane. Should it be desired, even a meander shaped inner housing could be designed. In an alternative embodiment, a catalytic muffler as described above could be designed without an intermediate wall to create two chambers. Instead, several bends of the inner housing could replace the function for heat transfer of the intermediate wall.

For facilitating the production of the exhaust gas muffler according to the present invention, the intermediate baffle separating the front and rear chamber is preferably a separate part fitted onto a shoulder of one of the two mating parts at assembly as evident from FIG. 1.

In one preferred embodiment the inner housing comprises a wall upstream the catalyst body dividing the flow into two parts. This could be done for example by simply putting a metal plate in the parting line of the two mating parts. This is advantageous from a durability point of view where particles can attach to the plate instead of possibly damaging the engine. Also, the heat radiation from the catalyst body is further decreased since the plate will absorb some of the heat. Alternatively, the upstream plate is arranged perpendicular to the parting line of the two mating parts. This upstream plate is then preferably inserted in slots of the two mating parts.

Preferably, the catalytic muffler further comprises a flow direction control part such that the exhaust gas is forced to change direction between the exhaust gas inlet and the catalyst. The thermal radiation from the catalyst is normally very high and therefore it is advantageous to have a change in the flow direction of the exhaust gases, i.e. such that the visibility of the catalyst from the exhaust gas inlet is decreased in order not to damage any part of the engine. For instance, the change in direction can be provided as a parallel displacement of the pipe or simply a bend. In combination with a plate upstream of the catalyst body and with this change of direction it is possible to eliminate direct heat radiation from the catalyst body to the inlet of the muffler and thereby protecting the engine.

In an alternative embodiment the inlet upstream of the catalyst body has at least one aperture for allowing untreated exhaust gas to enter the rear chamber. For some applications there is a need to keep the temperature further down in the catalyst and therefore a small part of the exhaust gas is bypassed.

Preferably, the inner housing is in contact with the intermediate baffle. For instance, when the second open end of the inner housing is arranged in the front chamber, the passage through the intermediate wall of the inner housing preferably coincides with the part of the inner housing holding the catalyst body, such that the opening area in the intermediate baffle is maximised and thereby allowing for proper heat conduction. In the alternative embodiment, with the second open end of the inner housing being arranged in the rear chamber, the inner housing could be bent such that it runs parallel with the intermediate baffle and thus also providing a larger contact area and sufficient heat conduction.

BRIEF DESCRIPTION OF THE FIGURES

Exemplary embodiments will now be further described with reference to the accompanying figures.

DESCRIPTION OF PREFERRED EMBODIMENTS

Figure 1:
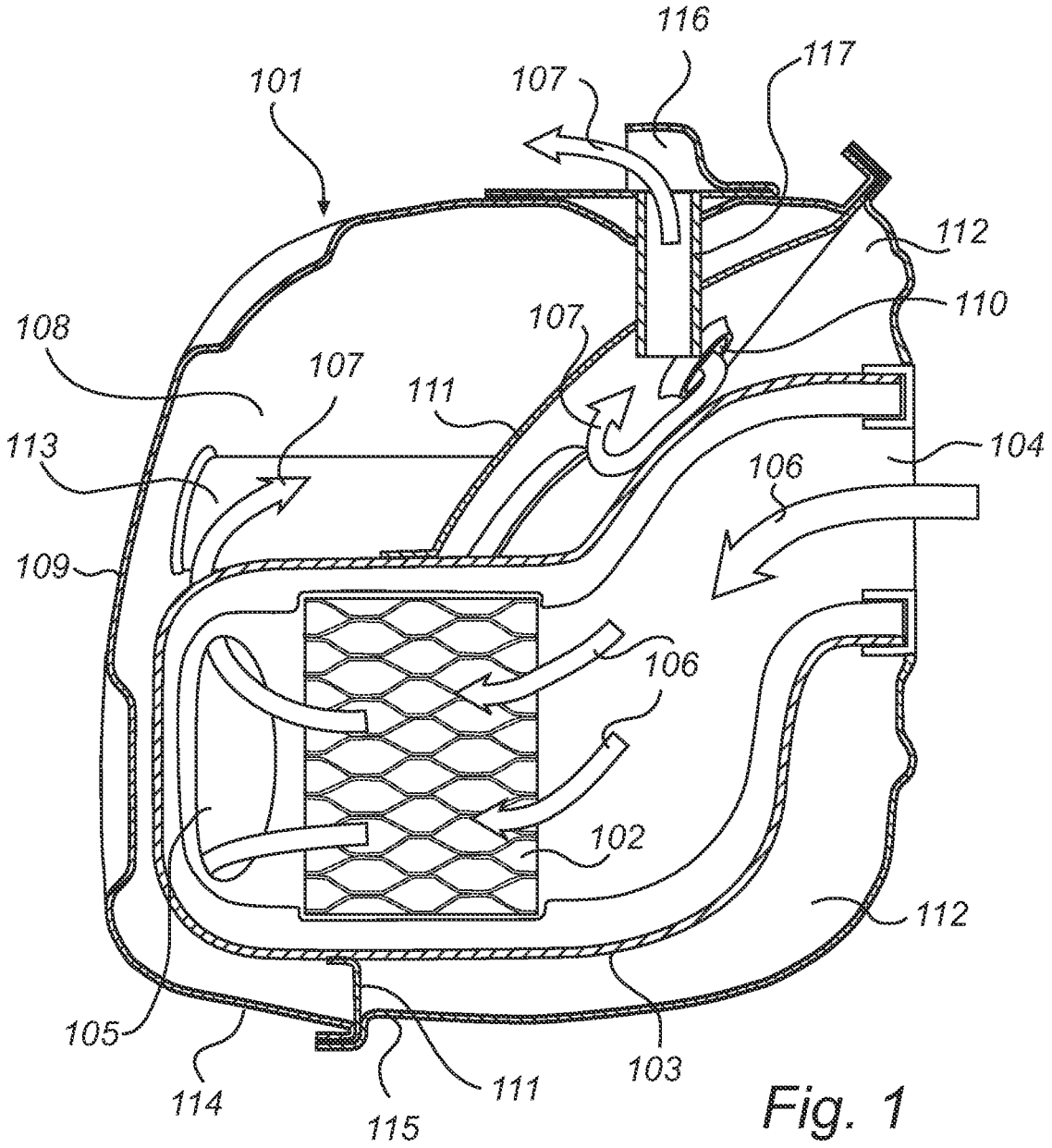
FIG. 1 is a cross section of a catalytic muffler according to one exemplary.
Figure 2:
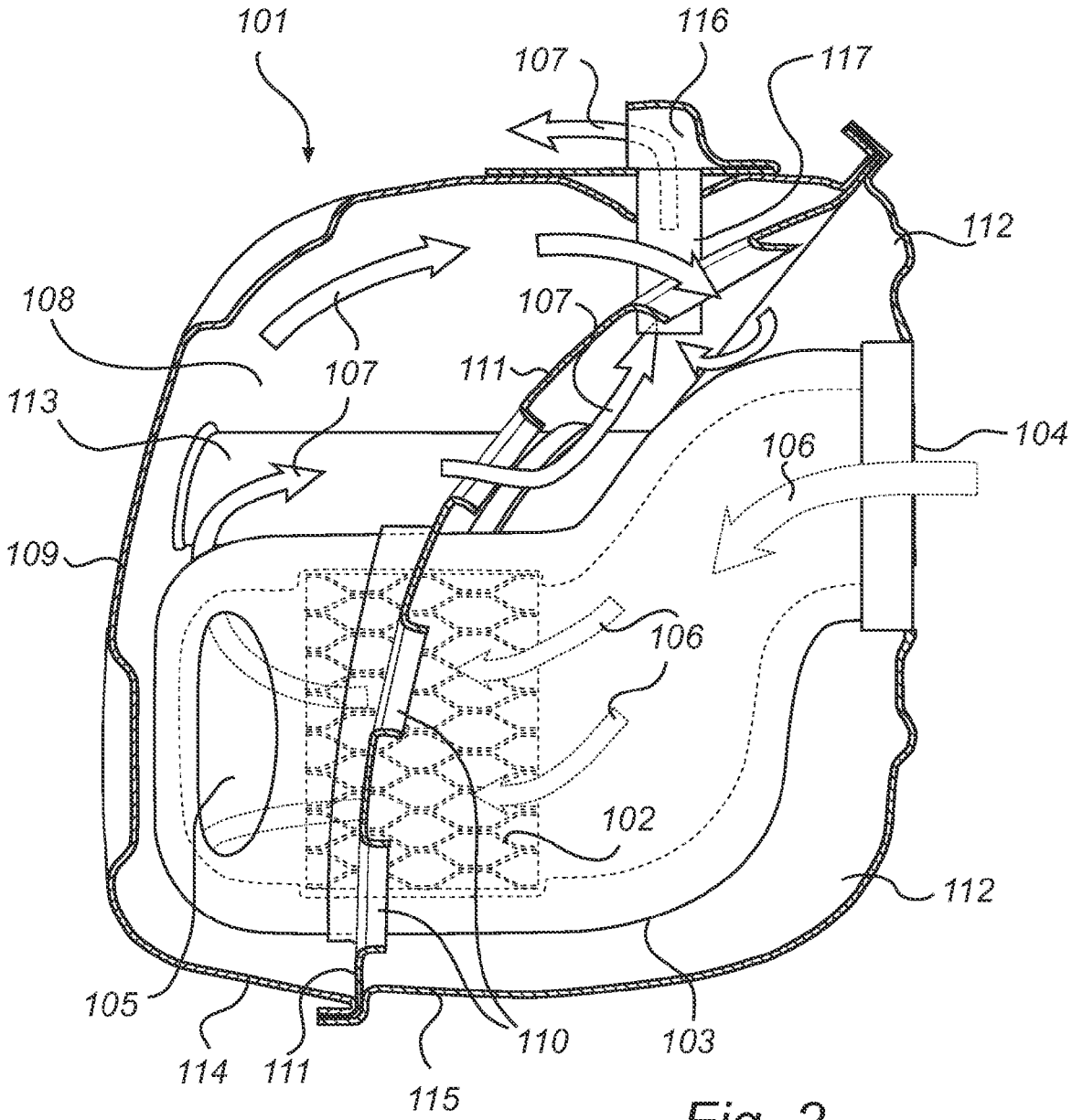
FIG. 2 is an alternative cross section of the catalytic muffler according to the embodiment shown in FIG. 1.

In FIGS. 1 and 2 a catalytic muffler 101 according to one of the embodiments of the present invention is shown. The muffler 101 comprises a catalyst body 102 arranged in a inner housing 103 with a first open end 104 and a second open end 105. The exhaust gas 106 from the combustion engine (not shown) enters the muffler 101 at the first open end 104 of the inner housing 103. The exhaust gas outlet from the combustion engine is directly attached to the first open end 104 of the inner housing 103. The inlet channel, i.e. the part of the inner housing upstream of the catalyst body 102, is in this embodiment bent twice in order to minimise the heat radiation from the catalyst body 102 to the first open end 104 and thus protecting the engine (not shown) from high temperatures. The exhaust gas 106 is treated when passing through the catalyst body 102. The treated gas 107 then exits the inner housing 103 at the second open end 105 of the inner housing 103 and enters the front chamber 108 where the gas is cooled due to heat transfer at housing 109. The treated gas 107 is forced to flow through apertures 110 that are arranged close to the housing 109 in an intermediate baffle 111 in order to maximise the cooling of the treated gas by convection heat transfer. When passing through the apertures 110, the treated gas 107 enters the rear chamber 112. In the rear chamber there is partly a counter current heat exchange between the exhaust gas 106 entering the muffler 101 in the inlet channel of the inner housing 103 and the treated gas 107 flowing into the rear chamber 112. Thus the treated gas 107 is further cooled and the exhaust gas 106 is heated prior to entering the catalyst body 102. The efficiency of the catalysis is, due to the heating of the exhaust gases 106 prior to entering the catalyst body 102, thus improved. In this embodiment tubes 113 are arranged to support the housing 109 of the muffler 101. The housing 109 of the muffler 101 is further divided into two mating parts 114 and 115. The muffler gas outlet 116 is in this embodiment arranged adjacent the front chamber 108 and the treated gas 107 exits the muffler 101 via a passage pipe 117 from the rear chamber 112. The contact surface area between the inner housing 103 and the intermediate baffle 111 is preferably as large as possible to allow for heat conduction from the inner housing 103 via the intermediate baffle 111 to the housing 109 of the muffler 101.

Figure 3:
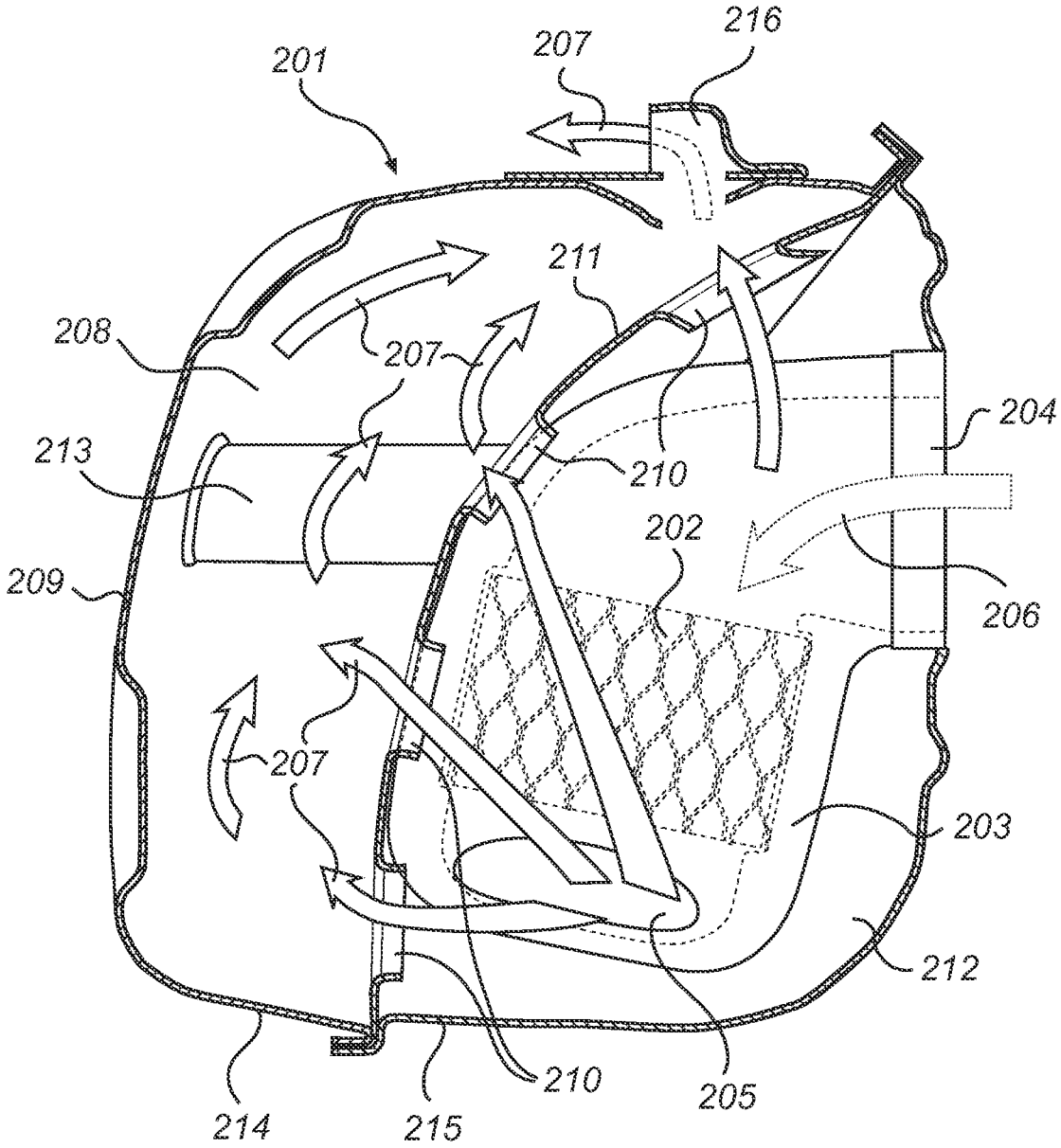
FIG. 3 is a cross section of a catalytic muffler according to an alternative embodiment of the present invention.

FIG. 3 shows an alternative embodiment of the catalytic muffler 201. The muffler 201 comprises a catalyst body 202 an inner housing 203 with a first open end 204 and a second open end 205. The exhaust gas 206 enters the muffler 201 at the first open end 204 and passes through the catalyst body 202. The treated gas 207 exits the inner housing 203 through the second open end 205 of the inner housing 203 in the rear chamber 212 (not in the front chamber 208 as compared to the embodiment in FIGS. 1 and 2). The treated gas 207 is forced to flow through the apertures 210 in the intermediate baffle 211. The apertures 210 are arranged close to the housing 209 of the muffler in order to enhance the cooling by convection of the treated gas 207. In this embodiment tubes 213 are used to support the housing 209 of the muffler 201. The housing 209 of the muffler 201 is further divided into two mating parts 214 and 215. The muffler gas outlet 216 is in this embodiment arranged in the front chamber 108 and the treated gas 107 exits the muffler 101 via the front chamber 208 and the outlet 216. Compared to the embodiment shown in FIGS. 1 and 2, the rear chamber 212 will hold a higher temperature, i.e. the part of the muffler 201 closest to the engine. This means that the front chamber 208 will be cooler and thus more user friendly since that part of the muffler 201 is more likely to come into contact with the user. Also, the inner housing 203 is bent such that the contact surface area between the inner housing 203 and the intermediate baffle 211 is maximised. This is advantageous as regards the heat transfer from the inner housing 203 to the intermediate baffle 211. The bent shape of the inlet channel of the inner housing 203 minimises the heat radiation from the catalyst body 202 to the engine (not shown). In order to further increase the contact surface between the inner housing 203 and the intermediate baffle 211, the joint connecting the two parts making up the inner housing is preferably made with a flange shaped and sized to optimize the contact with the intermediate baffle. Preferably this flange is fitted into a slot arranged in the intermediate baffle, compare FIG. 3 and imagine the flange cutting through the baffle for improved cooling and increased mechanical stability.

Figure 4:
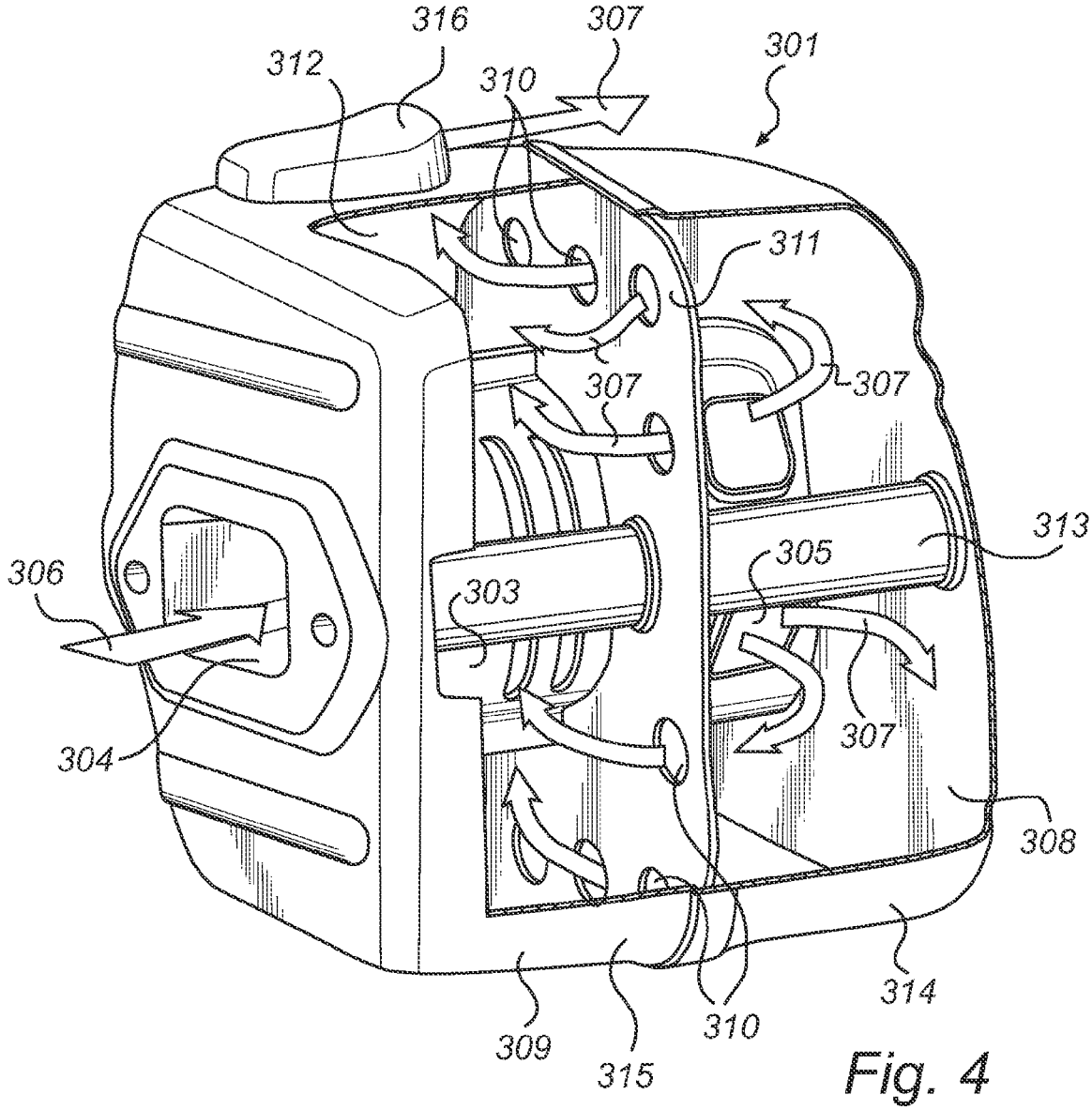
FIG. 4 is a perspective view of a further embodiment of the catalytic muffler according to one exemplary embodiment with parts of the housing cut out in order to illustrate the flow pattern.

FIG. 4 shows an alternative catalytic muffler 301 according to the present invention comprising a catalyst body, an inner housing 303 with a first open end 304 and a second open end 305 allowing the exhaust gas 306 to enter the muffler 301 at the first open end 304 flow through the inner housing 303 and the catalyst body. The treated gas 307 exits the inner housing 303 through the second open end 305 of the inner housing 303 into the front chamber 308. The treated gas 307 is forced to flow close to the housing 309 of the muffler 301 as a result of apertures 310 being arranged close to the housing 309 in an intermediate baffle 311 through which the treated gas 307 flows into the rear chamber 312. Also in this embodiment, tubes 313 are arranged in the muffler 301 to support the housing 309. The housing 309 is assembled from two mating housing parts 314 and 315. After entering the rear chamber 312 the treated gas exits the muffler 301 through an outlet 316. As in the embodiment shown in FIGS. 1 and 2, there is a counter current heat exchange between the incoming exhaust gas 306 in the inner housing 303 and the treated gas 307 flowing mainly in the opposite direction through both chambers. The inner housing 303 is also divided into two mating parts with a parting line 317.

Figure 5:
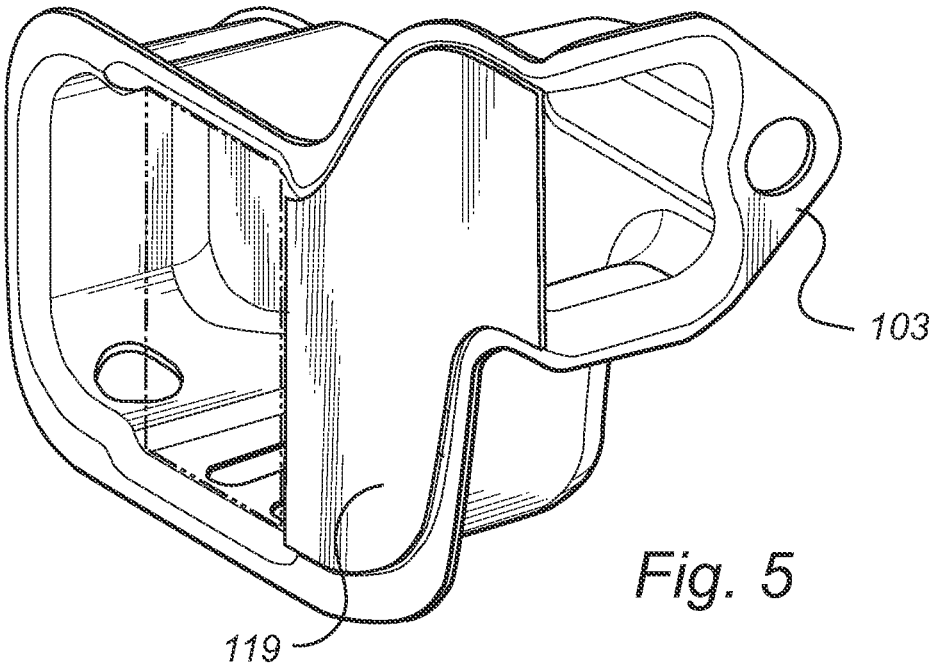
FIG. 5 is a perspective view of an alternative inner housing according to the embodiment of FIGS. 1 and 2.

FIG. 5 shows an example of an embodiment of the inner housing 103, or rather one half of the inner housing 103 with a flow dividing plate 119 positioned upstream of the position for the catalyst body (not shown in FIG. 5). An advantage with this flow dividing plate 119 is that the direct heat radiation from the catalyst body will be decreased since the plate 119 will absorb some of the heat.

Figure 6:
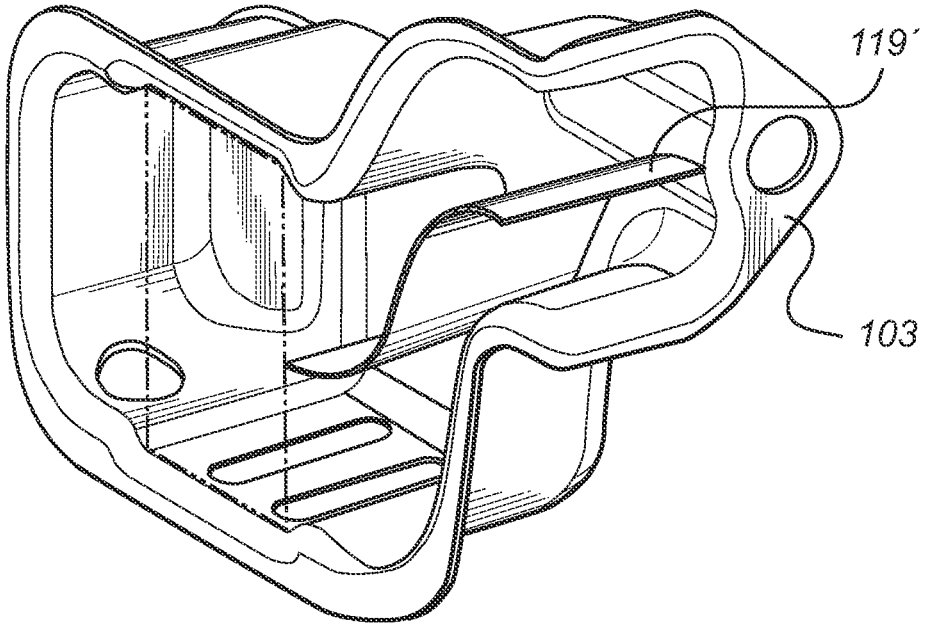
FIG. 6 is a perspective view of a further alternative inner housing according to the embodiment of FIGS. 1 and 2.

In FIG. 6, an alternative embodiment of the flow dividing plate 119' is shown. This solution is slightly more complex since it requires that a plate is bent instead of just cut as in the embodiment shown in FIG. 5 and then positioned in the inner housing 103. The positioning in the inner housing 103 could for instance be carried out by making a slot in the inner housing 103 in which the plate 119' is arranged. Just welding or soldering can be an alternative in order to facilitate the manufacturing. Even though the solution in FIG. 6 is more complicated from a manufacturing point of view, there is an advantage. Compared with the solution in FIG. 5, the solution shown in FIG. 6 eliminates the direct heat radiation from the catalyst body to the inlet of the muffler/inner housing 103.

In yet another alternative embodiment, the dividing plates 119 and 119' of FIGS. 5 and 6, respectively, could be combined such the inlet upstream the catalyst is divided into four parts (not shown). An advantage with this embodiment is that the dividing plate 119' could be attached to the dividing plate 119 by, for instance, by means of some sort of notch. The dividing plate 119 is, as described above, relatively easy to fasten, for instance, as a part of the contacting joint of the two mating parts of the inner housing.

Further, the arrangement of the tubes 113, 213, 313 shown in FIGS. 1-4 where there is a tube on both sides (one on each side) of the inner housing 103, 203, 303 allows for alternative design solutions as regards the inner housing 103, 203, 303. For instance, the shape of the inner housing can include additional bends and even be of a meander shaped.

Also, as described with the embodiment in FIG. 3, in order to increase the contact surface between the inner housing and the intermediate baffle, the joint connecting the two parts making up the inner housing is preferably made with a flange shaped and sized to optimize the contact with the intermediate baffle. This is also applicable to the embodiments shown in the other figures.

The foregoing is a disclosure of preferred embodiments for practicing the present invention. However, it is apparent that device incorporating modifications and variations will be obvious to one skilled in the art. Inasmuch as the foregoing disclosure is intended to enable one skilled in the art to practice the instant invention, it should not be construed to be limited thereby, but should be construed to include such modifications and variations as fall within the scope of the claims.

The invention claimed is:

1. A catalytic muffler for an internal combustion engine of a portable working tool comprising:

a housing designed to be directly attached to an exhaust port of an engine, the housing further comprising a front chamber and a rear chamber divided from each other by an intermediate baffle, wherein at least a first part of an inner surface of the front chamber constitutes a part of an outer wall of the housing, said housing further comprising an inner housing having a first open end constituting the exhaust gas inlet located in the rear chamber, said inner housing comprising a catalyst body through which essentially all exhaust gas flows, and wherein a second open end of the inner housing is arranged in the front chamber and an exhaust gas outlet of the muffler is arranged in the rear chamber, whereby treated gas exits the inner housing at the second open end of the inner housing and enters the front chamber, in which chamber the gas is cooled due to heat transfer at the housing, whereafter the treated gas flows through at least one aperture in the intermediate baffle from the front chamber to the rear chamber, wherein the first part has an inside, outside, and the inner surface, being the inside, of the one of said front and rear chamber constitutes a part of an outer wall of the housing.

2. The catalytic muffler according to claim 1, wherein the inner housing comprises at least one dividing plate upstream of the catalyst body dividing the flow into at least two parts.

3. The catalytic muffler according to claim 1, wherein the inlet upstream of the catalyst body is bent.

4. The catalytic muffler according to claim 1, wherein the inlet upstream of the catalyst body has two bends such that the direction of flow of the exhaust gas is substantially parallel when reaching the catalyst body as the direction of flow at the upstream end of the inlet.

5. The catalytic muffler according to claim 1, wherein the inlet upstream of the catalyst body has at least one aperture for allowing untreated exhaust gas to enter the rear chamber.

6. The catalytic muffler according to claim 1, wherein the inner housing is in contact with the intermediate baffle.

7. The catalytic muffler according to claim 1, wherein said portable working tool is a chain saw or a trimmer.

8. The catalytic muffler according to claim 1, wherein the inner surface of the front chamber is formed at an inside portion of the first part and an outside portion of the first part is the outer wall of the housing, whereby the heat is transferred directly through the first part.

9. The catalytic muffler according to claim 1, wherein the inner housing comprises two mating parts.

10. The catalytic muffler according to claim 9, wherein the joint between the two mating parts is arranged such that it is in an essentially vertical plane perpendicular to the exhaust inlet and the first end, thereby providing at least one bend in said plane.

11. The catalytic muffler according to claim 9, wherein at least one of the two mating parts has a recess for fitting the catalyst body.

12. A catalytic muffler for an internal combustion engine of a portable working tool comprising:

a housing designed to be directly attached to an exhaust port of an engine, the housing further comprising a front chamber and a rear chamber divided from each other by an intermediate baffle, wherein at least a first part of an inner surface of the rear chamber constitutes a part of an outer wall of the housing, said housing further comprising an inner housing having a first open end constituting the exhaust gas inlet located in the rear chamber, said inner housing comprising a catalyst body through which essentially all exhaust gas flows, and wherein a second open end of the inner housing is arranged in the rear chamber and an exhaust gas outlet of the muffler is arranged in the front chamber, whereby treated gas exits the inner housing at the second open end of the inner housing and enters the rear chamber, in which chamber the gas is cooled due to heat transfer at the housing, whereafter the treated gas flows through at least one aperture in the intermediate baffle from the rear chamber to the front chamber, wherein the first part has an inside, outside, and the inner surface, being the inside, of the one of said front and rear chamber constitutes a part of an outer wall of the housing.

13. The catalytic muffler according to claim 12, wherein the inner surface of the front chamber is formed at an inside portion of the first part and an outside portion of the first part is the outer wall of the housing, whereby the heat is transferred directly through the first part.

14. A catalytic muffler for an internal combustion engine of a portable working tool comprising:

a housing designed to be directly attached to an exhaust port of an engine, the housing further comprising a front chamber and a rear chamber divided from each other by an intermediate baffle, wherein at least a first part, having an inside, outside, of an inner surface, at the inside, of the one of said front and rear chamber constitutes a part of an outer wall of the housing, said housing further comprising an inner housing having a first open end constituting the exhaust gas inlet located in the rear chamber, said inner housing comprising a catalyst body through which essentially all exhaust gas flows a bent inlet upstream of the catalyst body, and wherein a second open end of the inner housing is arranged in one of said front and rear chambers and an exhaust gas outlet of the muffler is arranged in the other chamber, whereby treated gas exits the inner housing at the second open end of the inner housing and enters one of said front and rear chamber, in which chamber the gas is cooled due to heat transfer at the housing, whereafter the treated gas flows through at least one aperture in the intermediate baffle from one of said front and rear chamber to the other.

* * * * *